United States Patent [19]

Lim et al.

[11] 4,360,425

[45] Nov. 23, 1982

[54] LOW MOLECULAR WEIGHT COPOLYMERS AND TERPOLYMERS AS DEPRESSANTS IN MINERAL ORE FLOTATION

[75] Inventors: Sim K. Lim, Stamford; Richard M. Goodman, Norwalk, both of Conn.

[73] Assignee: American Cyanamid Company, Stamford, Conn.

[21] Appl. No.: 301,850

[22] Filed: Sep. 14, 1981

[51] Int. Cl.[3] ..... B03D 1/14

[52] U.S. Cl. ..... 209/167; 209/5; 252/61; 526/304; 210/735

[58] Field of Search ..... 209/166, 167, 59; 252/61; 210/735, 732; 526/304, 240

[56] References Cited

U.S. PATENT DOCUMENTS

| | | | |
|---|---|---|---|
| 3,256,140 | 6/1966 | Poschmann | 209/166 |
| 3,421,893 | 1/1969 | Taylor | 526/304 |
| 4,289,613 | 9/1981 | Goodman et al. | 209/167 |

*Primary Examiner*—Norman Yudkoff

*Attorney, Agent, or Firm*—Michael J. Kelly; Paul W. Leuzzi, II

[57] ABSTRACT

Low molecular weight compolymers and terpolymers of the general structure:

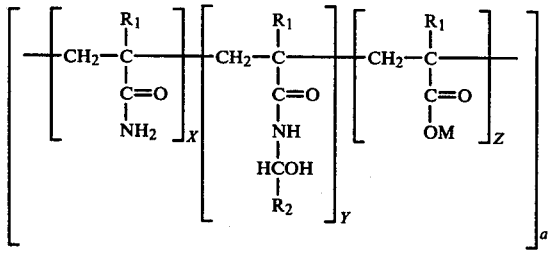

wherein $R_1$ is hydrogen or a methyl radical, $R_2$ is hydrogen or COOM and M is a hydrogen, alkali metal cation or ammonium ion, exhibit excellent depressive action in the flotation of non-sulfide mineral ores thereby resulting in improved selectivity and recovery. The low molecular weight copolymers and terpolymers, perform depressing action without resulting in any associated flocculation in the flotation system. These copolymers and terpolymers can be combined with other known depressing agents in nonsulfide ore flotation processes such as starch, dextrin, water soluble gum and the like, to obtain equivalent or improved selectivity and recovery than would be obtained using these depressants alone.

11 Claims, No Drawings

LOW MOLECULAR WEIGHT COPOLYMERS AND TERPOLYMERS AS DEPRESSANTS IN MINERAL ORE FLOTATION

BACKGROUND OF THE INVENTION

In mineral ore flotation, depression comprises steps taken to prevent the flotation of a particular mineral. In one-mineral flotation systems, it is commonly practiced to hold down both the gangue materials and low-assay middlings. In differential flotation systems, it is used to hold back one or more of the materials normally flotable by a given collector.

Depression is conventionally accomplished through the use of reagents known as depressing agents or, more commonly, depressants. When added to the flotation systems, the depressing agents exert a specific action upon the material to be depressed thereby preventing that material from floating. The exact mode of this action remains open to speculation. Various theories have been put forth to explain this action; some of which include: that the depressants react chemically with the mineral surface to produce insoluble protective films of a wettable nature which fail to react with collectors; That the depressants, by various physical-chemical mechanisms, such as surface absorption, mass-action effects, complex formation, or the like, prevent the formation of the collector film; that the depressants act as solvents for an activating film naturally associated with the mineral; that the depressants act as solvents for the collecting film; and the like. These theories appear closely related and the correct theory may ultimately prove to involve elements from several, if not all, of them.

Currently, nonsulfide flotation systems such as iron oxide utilize depressants derived from natural substances such as water soluble starches, dextrins, guar gums and the like. See U.S. Pat. No. 3,292,780 to Frommer et al. and U.S. Pat. No. 3,371,778 to Iwasaki. However, from an ecological vantage point, the presence of residual depressants such as these in the waste waters increase the biodegradeable oxygen demand and the chemical oxygen demand, thereby creating a pollution problem in the disposal of these waste waters. From a commercial vantage point, there is an ever-increasing number of countries in which use of reagents having a food value, such as starch, is prohibited in commercial applications. Furthermore, the starch-type depressants require a complex preparation of the reagent solution involving a cooling stage prior to solution and the resultant reagent is susceptible to bacterial decomposition thereby requiring storage monitoring.

In other nonsulfide mineral ore flotation processes, such as sylvinite ore, the gangue clay is depressed whereas the valuable sylvite is floated with the aid of amine collectors. Various depressants, also referred to as blinding agents, used in these flotation systems have been described in U.S. Pat. Nos. 3,452,867 to Bishop; 3,782,546 to Kirwin; 3,805,951 to Brogoitti 3,456,790 to Fast; 2,288,497 and 2,364,520; and in German Offen 1,267,631 to Budan and Canadian Pat. No. 932,485 to Fee. Various other nonsulfide mineral ore depressants have been described in U.S. Pat. Nos. 3,572,504 to DeCuyper; 2,740,552 to Aimone and 3,929,629 to Griffith as well as in U.S.S.R. Pat. Nos. 130.428 to Gurvich and 141.826 to Livhits. In all of the aforementioned references the depressants disclosed are distinct in chemical structure and many properties than those employed in the instant process.

Accordingly, there exists the need for a synthetic depressant which can at once overcome the drawbacks of the conventional depressants currently utilized and yet perform in an equivalent or superior manner.

SUMMARY OF THE INVENTION

The present invention provides a method for concentrating valuables by subjecting an aqueous slurry of a non-sulfide mineral to a froth flotation process in the presence of a collector and a synthetic depressant.

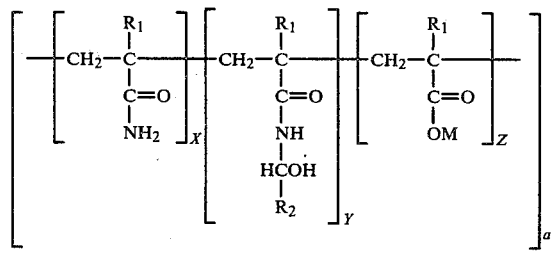

wherein $R_1$ is hydrogen or a methyl radical, $R_2$ is hydrogen or COOM and M is a hydrogen, alkali metal cation or ammonium ion, and X represents the residual percent mol fraction, Y is a mol fraction ranging up to about 50 percent, preferably to 25 percent, and Z is a mol fraction ranging from about 0 to 45 percent, and X, Y, Z and a have a numerical value such that the total molecular weight of the copolymer or terpolymer is within the range from about 200 to 500,000. The process of the instant invention concentrates nonsulfide minerals as well as comparable processes employing depressants derived from natural substances, such as starch, at approximately one-tenth to one-half the dosage, calculated on active ingredient of depressant. The instant process, besides overcoming the deficiencies attributable to employing non-synthetic depressants as set forth earlier, does not result in flocculation of the depressed mineral values.

DETAILED DESCRIPTION OF THE INVENTION

In accordance with the instant invention there is provided a process for concentrating monosulfide minerals in a flotation system. The process comprises adding to the flotation system a synthetic depressant during the flotation stage. The synthetic depressant employed in this process is a low molecular weight copolymer or terpolymer of general Structure I. The molecular weight of the synthetic depressant should be within the range from about 200 to 500,000 and preferably within the range from about 1,000 to 100,000. The useful ratio of X:Y:Z expressed in percent mol fraction should be from about 12 to 95:5 to 44 respectively and preferably 95 to 70/5 to 20/0 to 10.

Essentially Structure I illustrates a water soluble polymer comprising nonionic and anionic monomers. Examples of water soluble anionic monoethylenically unsaturated monomers are acrylic and methacrylic acid, 2-acrylamido 2-methyl propanesulfonic acid, styrene sulfonic acid, 2-sulfoethyl methacrylate, vinyl sulfonate, maleic acid, fumaric acid, crotonic acid and their respective sodium, potassium and ammonium salts.

Examples of water soluble nonionic monoethylenically unsaturated monomers are acryl and methacrylamide, N-isopropylacrylamide, N-methylol acrylamide, hydroxyethyl acrylate and methacrylate and acrylonitrile. Examples of monomers containing both nonionic and anionic moiety are N-acryl and N-methacrylamido glycolic acid, and N-methylolacrylamido-N-glycolic acid. The chemical composition of the aforesaid compound is disclosed in U.S. Pat. No. 3,442,139 (P. Talet to Nobel-Bozel, Jan. 14, 1969).

The preferred monomers, however, are acrylamide, N-acrylamido glycolic acid, acrylic acid and N-methylol acrylamide. The general Structure I can also be obtained by chemical modification of polyacrylamide as described hereunder:

1. N-methylolation reaction with formaldehyde. The addition of formaldehyde under alkaline condition at a temperature below 40° C. results in a polymer consisting of units of N-methylol acrylamide and acrylamide. Reaction temperature above 40° C. produces units of alkaline salts of acrylic acid, acrylamide and N-methylol acrylamide.

2. Reaction with glyoxylic acid. Polyacrylamide reaction with glyoxylic acid in alkaline medium at a temperature below 40° C. gives a polymer with units of acrylamide, N-acrylamido glycolic acid salt. At a temperature higher than 40° C., the polyacrylamide solution hydrolyzes and yields a polymer solution with units of acrylamide, N-acrylamido glycolic acid salt and acrylic acid salt.

The term "polyacrylamide" is used as convenient understandable terminology rather than to limit the process of manufacture. Reagents which have been found particularly useful for hydrolysis of the polyacrylamide include NaOH, KOH and $NH_4OH$.

The resulting low-molecular weight copolymer or terpolymer when employed as a depressant in the flotation system exhibits improved selectivity and recovery over conventional depressants at substantially lower dosages of depressant. The synthetic depressant is easily diluted with water to provide a reagent solution that, due to its nonsusceptibility to bacterial decomposition, can be stored almost indefinitely. The synthetic depressants should be added in an effective amount to obtain the desired degree of depression. Although this amount will vary depending upon the ore being processed, the flotation collector being employed, and other variables, it is generally on the order of about 0.01 to 0.20 pound of depressant calculated on active ingredient per long ton of ore. This value is from one-sixth to one-fourth that dosage normally required to obtain equivalent recovery with starch depressants. Additionally, the instant process is capable of employing a combination of the synthetic depressants with a conventional, naturally derived depressant, such as starch, modified starch derivatives, and guar gums to arrive at substantially equivalent or improved performance to that obtained when employing the conventional depressant alone.

The following specific examples illustrate certain aspects of the present invention and, more particularly, point out methods of evaluating the process for concentrating nonsulfide minerals in a flotation system. However, the examples are set forth for illustration only and are not to be construed as limitations on the present invention except as set forth in the appended claims. All parts and percentages are by weight unless otherwise specified.

EXPERIMENTAL PROCEDURE I

Step 1: Grinding

Mix 600 Parts of crude iron ore having a particle size of minus 10 mesh with 400 ml. of deionized water, 5.0 ml. of a 2% sodium silicate "N" solution and 1.8 ml. of a 25% NaOH solution.

Subject the resulting mixture to grinding in a rod mill for 50 minutes and thereafter transfer it into an 8 liter cylinder. To this cylinder, add 200 ml. of 0.05% $Ca(OH)_2$ solution and an amount of deionized water sufficient to fill the cylinder to the 8 liter mark.

Step 2: Desliming

Subject the cylinder mixture to mechanical stirring for 1 minute during which time there is added 6.9 parts of a 1% corn starch solution as the desliming aid. The stirring is then stopped and the mixture is allowed to settle for 12 minutes, after which approximately 7 liters of the supernatant layer is syphoned off and filtered, resulting in the slime product.

Step 3: Rougher Float

Transfer the remaining 1 liter underflow to a flotation bowl. Water containing 17 ppm of calcium as $CaCO_3$ is added to the bowl until the level reaches the lip. The pulp is briefly agitated at 1200 rpm and thereafter the pH is adjusted to approximately 10.6 through the addition of 5–10 drops of 10% NaOH. 27.3 Parts of a 1% starch solution is then added as a depressant and a two-minute conditioning time is allowed.

4.9 Parts of a 1% solution of a commercially available amine collector is added, 30 seconds of conditioning is allowed followed by a four-minute float. After the float, 3.3 parts of a 1% solution of a commercially available amine collector is again added, 30 seconds of conditioning is allowed and then followed by a second four-minute float.

The froth collected from the first and second floats is labeled the rougher froth and the remainder in the flotation bowl is labeled the rougher concentrate.

Step 4: Scavenger Float

Transfer the rougher float to a second flotation bowl to which there is added 13.6 parts of a 1% corn starch solution as a depressant. Two minutes of conditioning is allowed before air is introduced into this bowl for 3–4 minutes. The forth collected is labeled final froth.

Step 5: Middling Float

The underflow from the scavenger float of Step 4 is further conditioned for 30 seconds with 1.4 parts of a 1% solution of a commercially available amine collector and thereafter floated for 3 minutes. The middling float sequence is repeated a second time and the combined froth from these two floats is labeled the middling froth. The underflow remaining is combined with the rougher concentrate and labeled the final concentrate and the percent grade, insolubles and recovery of this final concentrate are given in Tables I through IV.

COMPARATIVE EXAMPLE A

The Experimental Procedure set forth above is followed in every material detail employing as the depressant 1.5 pound of dry corn starch per long ton of iron ore in the flotation steps. Test results are set forth in Table I.

EXAMPLES 1–4

The Experimental Procedure set forth above is followed in every material detail employing as the depressant 0.5 pound of the synthetic depressants in place of the corn starch used during the flotation steps. Test results and details are set forth in Table I as a function of the molar percentage of acrylamide glycolic acid (AGA) in acrylamide AGA copolymers.

TABLE I

Iron Ore Performance of Synthetic Depressants as a Function of the Molar Percentage of Acrylamide Glycolic Acid (AGA) in Acrylamide-AGA Copolymers

| Examples | Depressant | Dose lb./LT | Collector | Dose lb./LT | Final Concentrate % Grade | % Insol | % Recovery |
|---|---|---|---|---|---|---|---|
| Comp. A | Corn Starch | 1.5 | Commercial Amine | 0.4 | 66.9 | 4.78 | 75.15 |
| 1 | Synthetic A | 0.5 | " | 0.3 | 67.3 | 4.84 | 74.00 |
| 2 | Synthetic B | 0.5 | " | 0.3 | 66.1 | 4.18 | 75.41 |
| 3 | Synthetic C | 0.5 | " | 0.3 | 68.2 | 3.54 | 72.80 |
| 4 | Synthetic D | 0.5 | " | 0.3 | 67.3 | 4.72 | 75.82 |

Synthetic A Copolymer AMD/AGA 75/25% mole prepared from monomers, molecular weight 6300.
Synthetic B Copolymer AMD/AGA 88/12% mole prepared from monomers, molecular weight 8800.
Synthetic C Reaction Product of PAM with glyoxylic acid (6% mole), molecular weight 7000.
Synthetic D Reaction Product of PAM with glyoxylic acid (12% mole), molecular weight 7000.

EXAMPLES 5–9

The Experimental Procedure set forth above is followed in every material detail employing as the depressant 0.5 pound of synthetic depressant per long ton of iron ore in the flotation steps. Table II compares the iron ore performance using a commercial amine without depressant (Example 9) and with depressant (Examples 5–8) with various degrees of carboxylation and/or methylolation.

TABLE II

Iron Ore Performance of Synthetic Depressants with Various Degree of Carboxylation and/or Methylolation of Polyacrylamide (PAM)

| Example | Depressant PAM % Methylol-ation | % Carboxyl-ation | Dose lb./LT | Collector | Dose lb./LT | Final Concentrate % Grade | % Insols | % Recovery |
|---|---|---|---|---|---|---|---|---|
| 5 | 0 | 0 | 0.5 | Commercial Amine | 0.3 | 66.9 | 3.75 | 69.91 |
| 6 | 22 | 22 | " | " | " | 67.3 | 4.00 | 74.09 |
| 7 | 12 | 12 | " | " | " | 66.8 | 4.66 | 73.0 |
| 8 | 44 | 44 | " | " | " | 67.1 | 5.14 | 73.98 |
| 9 | No depressant | | None | " | " | 67.0 | 4.22 | 63.27 Blank, without depressant |

EXAMPLES 10–13

The Experimental Procedure set forth above, is followed in every material detail employing as the depressant 0.19 pound of a mixture of polyacrylamide/glyoxylic acid (12% mole) and corn starch or Amioca 35 per long ton of iron ore in the flotation steps. Table III shows the results of iron ore performance using such a mixture as compared to using as the depressant 1.5 pound of corn starch per long ton of iron ore and to using no depressant in the flotation procedure.

TABLE III

Iron Ore Performance of Mixture of Synthetic Depressant/Starch

| Example | Depressant | Dose lb./LT | Collector | Dose lb./LT | Final Concentrate % Grade | % Insol | % Recovery |
|---|---|---|---|---|---|---|---|
| 10 | Synthetic D<br>Corn Starch | 0.19<br>0.19 | Commercial Amine | 0.35 | 66.5 | 5.23 | 75.85 |
| 11 | Synthetic D<br>Amioca 35 | 0.19<br>0.19 | " | 0.37 | 65.78 | 6.10 | 81.81 |
| 12 | No depressant | None | " | 0.35 | 66.5 | 6.34 | 56.81 Blank, without depressant |
| 13 | Corn Starch | 1.5 | " | 0.40 | 67.2 | 4.19 | 74.31 |

Synthetic D = Reaction product of PAM with glyoxylic acid (12% Mole) molecular weight 7000
Amioca 35 = Fluidized waxy corn starch

EXAMPLES 14–15

The Experimental Procedure set forth above is followed in every material detail employing as the depressant 0.18 pound of the reaction product of carboxyl and glycolic acid containing polyacrylamide per long ton of iron ore. Table IV illustrates the iron ore performance of the synthetic depressant as compared to 1.5 pound of corn starch.

TABLE IV

Iron Ore Performance of Synthetic Depressant with Carboxyl and Glycolic Acid Containing PAM

| Example | Depressant | Dose lb./LT | Collector | Dose lb./LT | Final Concentrate % Grade | % Insol | % Recovery |
|---|---|---|---|---|---|---|---|
| 14 | Synthetic E | 0.18 | Commercial Amine | 0.41 | 65.2 | 5.28 | 75.2 |
| 15 | Corn Starch | 1.5 | " | " | 66.5 | 5.65 | 76.4 |

Synthetic E Terpolymer of AMD/AA/GA 56/40/4 mole.

EXPERIMENTAL PROCEDURE II

Step 1: Conditioning of the Float Feed

After grinding the iron oxide float feed has the following particle size distribution:

| | |
|---|---|
| 4.1% | minus 2.8 um |
| 23.7% | 2.8 to 9.0 um |
| 46.1% | 9.0 to 40.0 um |
| 26.1% | 40.0 to 100.0 um |

1293 Grams of the feed, corresponding to 1000.0 grams of ore, transfer to the Wemco Lab flotation machine, operating at 1100 rpm and diluted with tap water in order to get approximately 31% solids. The pH is raised to 9.0 with 10% NaOH and the pulp conditioned for 2 minutes, followed by raising the pH to 10.3 with 10% NaOH and subsequently dextrin at 0.97 lb./long ton is added. The pulp is conditioned for 2 minutes and 20 seconds, followed by the addition of commercial amine collector (0.30 lb./long ton) and commercial frother (0.14 lb./long ton). The pulp is conditioned for 30 seconds.

Step 2: Rougher Flotation

To the overflow OF1 is added commercial dextrin (0.25 lb./long T) and conditioned for 15 seconds, followed by scavenger flotation for 2 minutes. The resulting overflow OF2 and underflow UF2 gives final tail and scavenger concentrate respectively.

Step 4: Cleaner Flotation

To the underflow UF1 is added commercial amine (0.05 lb./long T) and conditioned for 15 seconds, followed by cleaner flotation for 2 minutes, which gives overflow OF3 (cleaner tail) and underflow UF3 (final concentrate).

Step 5: Final Flotation

To the overflow OF1 is added dextrin at (0.25 lb./long ton) and conditioned for 15 seconds, followed by scavenger flotation for 2 minutes. The resulting overflow OF2 and underflow UF2 give final tail and scavenger concentrate respectively.

EXAMPLES 16–19

The Experimental Procedure II set forth above is followed in every material detail employing as the synthetic depressant 0.30 pound of the reaction product of polyacryl—amide and glyoxylic acid (9% mole) per long ton of iron ore. Table V compares the results of iron ore performance of Synthetic F with 1.22 pound of dextrin per long ton of iron ore as the depressant. Example 17 clearly shows that Synthetic F at 0.30 lb./long T, thus at a quarter dose of dextrin, performs better than dextrin. It should also be pointed out that no frother was used which means a reduction in reagent cost. The addition of frother is dextrimental, as a matter of fact, as demonstrated in Example 19, due to excessive foaming. A significant feature of Synthetic F is the substantially lower iron loss in the cleaner and final tails and correspondingly an extremely high percentage of $SiO_2$ in tails as shown in Examples 17 and 18.

TABLE V

Comparison of Iron Ore Performance of Synthetic Depressant with Dextrin

| Example | Depressant Type | Dose lb./LT | Frother lb./LT | % Fe Rougher Conc. | Scav. Conc. | Clean Tail | Final Tail | % $SiO_2$ Rougher Conc. | Scav. Conc. | Clean Tail | Final Tail |
|---|---|---|---|---|---|---|---|---|---|---|---|
| 16 | Dextrin | 1.22 | 0.14 | 63.7 | 47.1 | 52.6 | 5.7 | 2.3 | 24.5 | 16.1 | — |
| 17 | Synthetic F | 0.30 | None | 64.1 | 51.0 | 37.8 | 7.4 | 1.5 | 19.9 | 41.4 | — |
| 18 | " | 0.30 | None | 63.2 | 49.9 | 35.3 | 6.9 | 3.6 | 21.2 | 44.3 | — |
| 19 | " | 0.30 | 0.14 | 65.4 | 55.0 | 52.0 | 9.0 | 2.1 | 14.9 | 17.8 | — |

| Example | % Recovery Rough. Conc. | Scav. Conc. | Clean Tail | Final Tail | Final Concentrate Fe Grade | $SiO_2$ | Fe Recovery |
|---|---|---|---|---|---|---|---|
| 16 | 88.2 | 5.6 | 4.3 | 1.8 | 62.3 | 4.1 | 93.8 |
| 17 | 89.2 | 4.6 | 4.1 | 2.1 | 63.7 | 4.4 | 93.8 |
| 18 | 89.7 | 4.6 | 3.8 | 1.8 | 62.4 | 4.6 | 94.3 |
| | | | | | | | See Remark 3 |
| 19 | 82.0 | 7.9 | 6.7 | 3.4 | 64.3 | 3.4 | 90.0 |

Remarks:
(1) All flotation tests were run with commercial amine at 0.35 lb./LT, except example 18 at 0.31 lb./LT.
(2) The grade, $SiO_2$ and recovery of the final concentrate were calculated from combined rougher and scavenger results.
(3) Commercial Amine at 0.31 lb./LT.
(4) Synthetic F = Reaction product of PAM with glyoxylic acid (9% mole) molecular weight 7000.

EXPERIMENTAL PROCEDURE III

Step 1: Scrubbing

Place 800 Grams of ground potash ore in a float cell, fill with saturated brine solution and scrub for 5 minutes.

Step 2: Decanting of Slimes

Transfer the pulp to a 5 liter cylinder, stir for 1 minute and settle for 1 minute. The slimes are decanted from the settled solids and 1000 ml. of brine solution is poured into the cylinder. After 1 minute mixing and 1 minute settling the slimes are decanted again.

Step 3: Conditioning

Add to the settled pulp 300 ml. of brine and add under stirring the following reagents in the following order:

| | |
|---|---|
| 17 ml. commercial guar gum | (15 seconds conditioning time) |
| 3 ml. commercial amine | (10 seconds conditioning time) |
| 4 drops oil | ( 5 seconds conditioning time) |
| 4 drops commercial frother | ( 5 seconds conditioning time) |

Step 4: Flotation

Transfer the pulp to the float cell, add brine to fill the cell and float for 2 minutes, producing the concentrate and tail. The results are tabulated in table VI.

TABLE VI

Potash Ore Performance of Acrylamide-Acrylamido Glycolic Acid Copolymer

| | Depressant | Dose, lb./T | | Concentrate | | | |
|---|---|---|---|---|---|---|---|
| Example | Type | Depressant | Amine | Weight, gram | % $K_2O$ | % Insol | % Recovery |
| 20 | Synthetic G | 0.18 | 0.10 | 131 | 55.16 | 1.51 | 54.1 |
| 21 | Guar Gum | 0.34 | 0.10 | 138 | 51.83 | 1.12 | 53.6 |

Synthetic G = Reaction product of PAM with glyoxylic acid (9% mole) Molecular Weight 32,000.

EXAMPLE 22

When the Experimental Procedure I set forth above is employed in the flotation process wherein copper is separated from molybdenite, depression performance substantially equivalent to that achieved in an iron ore flotation system is obtained employing a copolymer of acrylamide/N-acrylamido glycolic acid of 88:12 mole percent composition respectively having a molecular weight of 7000 as the depressant.

EXAMPLE 23

When the Experimental Procedure I set forth above is employed in the flotation process wherein galena is separated from chalcopyrite and sphalerite, depression performance substantially equivalent to that achieved in an iron ore flotation system is obtained employing a copolymer of acrylamide/N-acrylamido glycolic acid of 88:12 mole percent composition respectively having a molecular weight of 1000 as the depressant.

EXAMPLE 24

When the Experimental Procedure I set forth above is employed in the flotation process wherein apatite is separated from gangue depression performance substantially equivalent to that achieved in an iron ore flotation system is obtained employing a copolymer of acrylamide/N-acrylamido glycolic acid of 88:12 mole percent composition respectively having a molecular weight of 6800 as the depressant.

EXAMPLE 25

When the Experimental Procedure I set forth above is employed in the flotation process wherein fluorspar is separated from calcite, depression performance substantially equivalent to that achieved in an iron ore flotation system is obtained employing a copolymer of acrylamide/N-acrylamido glycolic acid of 88:12 mole percent composition respectively having a molecular weight of 5000 as the depressant.

We claim:

1. A process for concentrating nonsulfide mineral values in a flotation system which comprises adding to the flotation system, as a selective depressant, an effective amount of a copolymer or a terpolymer or water soluble salts thereof of the general structure:

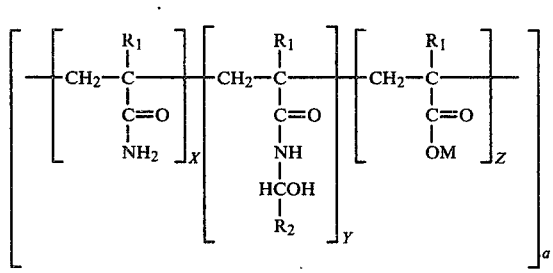

wherein $R_1$ is hydrogen or a methyl radical, $R_2$ is hydrogen or COOM and M is a hydrogen, alkali metal cation or ammonium ion, and X represents the residual percent mol fraction, Y is a mol fraction ranging up to about 50 percent, preferably 25 percent and Z is a mol fraction ranging from about 0 to 45 percent and X, Y, Z and a have a numerical value such that the total molecular weight of copolymer or terpolymer is within the range from about 200 to 500,000.

2. The process of claim 1 wherein the molecular weight is within the range from 1000 to 500,000.

3. The process of claim 1 whereby the ratio of X:Y:Z expressed in mol fraction is from 12 to 95:5 to 44:0 to 44 respectively.

4. The process of claim 3 whereby the ratio of X:Y:Z expressed in percent mol fraction is 70 to 95:5 to 20:0 to 10, respectively.

5. The process of claim 1 wherein said depressant is a mixture of a naturally derived depressant and said copolymer or said terpolymer of water-soluble salt thereof.

6. The process of claim 5 wherein said naturally derived depressants are selected from the group consisting of starch and guar gum.

7. The process of claim 1 wherein said synthetic depressant is a copolymer of Acrylamide/N-acrylamido glycolic acid of 88:12 mole percent composition, respectively.

8. The process of claim 1 wherein the effective amount of the active ingredient of synthetic depressant is about 0.10 to 0.50 pound per long ton of nonsulfide mineral ore.

9. The process of claim 1 wherein the non-sulfide mineral ore is iron ore.

10. The process of claim 1 wherein the non-sulfide mineral ore is potash ore.

11. The process of claim 1 wherein the nonsulfide mineral ore is phosphate ore.

* * * * *